US006132230A

United States Patent [19]

Shinozaki et al.

[11] Patent Number: 6,132,230

[45] Date of Patent: Oct. 17, 2000

[54] CONNECTOR

[75] Inventors: Tetsuya Shinozaki; Kouji Nemoto, both of Yokkaichi, Japan

[73] Assignee: Sumitomo Wiring Systems Ltd., Japan

[21] Appl. No.: 09/251,397

[22] Filed: Feb. 17, 1999

[30] Foreign Application Priority Data

Mar. 2, 1998 [JP] Japan ..... 10-049888

[51] Int. Cl.[7] ..... H01R 13/52; H01R 13/627

[52] U.S. Cl. ..... 439/281; 439/352

[58] Field of Search ..... 439/281, 282, 439/271, 272, 936, 352, 354, 358, 521, 595

[56] References Cited

U.S. PATENT DOCUMENTS

| | | | |
|---|---|---|---|
| 4,806,123 | 2/1989 | Konishi et al. | 439/595 |
| 4,875,870 | 10/1989 | Hardy et al. | 439/204 |
| 5,509,829 | 4/1996 | Saba | 439/752 |
| 5,588,856 | 12/1996 | Collins et al. | 439/204 |
| 5,660,555 | 8/1997 | Ito et al. | 439/278 |
| 5,664,966 | 9/1997 | Maegawa et al. | 439/595 |
| 5,863,216 | 1/1999 | Tsuji et al. | 439/489 |
| 5,997,344 | 12/1999 | Shinozaki | 439/489 |

*Primary Examiner*—Khiem Nguyen
*Assistant Examiner*—Son V. Nguyen
*Attorney, Agent, or Firm*—Banner & Witcoff, Ltd.

[57] ABSTRACT

To effect water-proofing using a non-water-proof type of female connector, a non-water-proof female connector (20) is fitted with a concave fitting member (12) of a male connector (10), a cover assembly (30) fitting with both the female connector (20) and the concave fitting member (12). The cover assembly (30) is provided with a ring-shaped seal (40) which fits tightly with the rim of the circumference of the fitting member (12), thereby sealing the portions of the two connectors (10) and (20) that fit together. A gel seal (45) is compressed between the cover assembly (30) and the rear face of the female connector (20), this preventing water from entering via terminal attachment holes (21) on the rear face of the female connector (20).

11 Claims, 6 Drawing Sheets

CONNECTOR

TECHNICAL FIELD

The present invention relates to a water-proof electrical connector.

BACKGROUND TO THE INVENTION

One example of a water-proof connector is shown in JP-63-193471. This is provided with a male connector having a concave fitting member, and a female connector which fits into the concave member, the fitting portions of the two connectors being water-proofed by a ring-like seal member. Cylindrical rubber plugs are fitted on electric wires and are passed through terminal insertion holes in the rear face of each connector. The electric wires make contact with terminal fittings. These rubber plugs fit with the interior of the terminal insertion holes and thereby effect water-proofing.

Non-water-proof connectors, particularly female connectors into which square box-shaped female terminal fittings are inserted, have square terminal insertion holes openings in order to guide the square box-shapes, whereas the water-proof connectors described above have circular terminal insertion holes and rubber plugs in order to improve their seal.

Consequently, if one wants to effect water-proofing by fitting rubber plugs to each terminal insertion hole, the shape of the terminal insertion hole differs according to whether the connector is of a water-proof or non-water-proof type. As a result, the connectors cannot be interchanged. In particular, it is almost impossible to use a non-water-proof connector as a water-proof connector due to the sealing problems this would cause.

However, a water-proofing means which does not employ rubber plugs is described in JP-64-63282. This provides the rear face of the connector with a cover and has a layer of gel between the cover and the rear face of the connector, this gel covering a plurality of terminal insertion holes and thereby providing a seal. Accordingly, water-proofing is achieved irrespective of the shape of the openings of the terminal insertion holes.

Nonetheless, in this method of water-proofing, the cover seals only the terminal insertion holes on the rear face of the connector, and does not seal the fitting portion between this connector and the corresponding connector. As a result, a different sealing means is required.

SUMMARY OF THE INVENTION

According to the invention there is provided an electrical connector assembly comprising a male connector, and a female connector adapted to connect therewith, the female connector having terminal insertion apertures at the side opposite to the male connector, the assembly further including a waterproofing cover for said female connector and having a peripheral seal for sealing engagement with the periphery of said male connector, said cover having through apertures in register with said terminal insertion apertures, characterized in that said assembly further includes a gel seal interposed between said female connector and cover, said gel seal being adapted to allow electrical terminals to be passed therethrough from said through apertures to said terminal insertion apertures, and adapted to seal said apertures against passage of moisture.

Such an arrangement provides complete waterproofing for the female connector without the necessity of specially shaped sealing plugs and the like. Accordingly either a waterproof type female connector or a non-waterproof type can be utilized.

Preferably the connector assembly includes a releasable latch operable through a flexible waterproofing member of the cover. The assembly may include retention means between the cover and female connector to aid assembly and to retain the gel seal in an uncompressed state whilst the necessary terminals are inserted in the female connector. Provisions of the cover may be provided in order to restrict lateral deformation of the gel seal.

Several gel seals may be provided in the same plane in order to waterproof terminal insertion apertures which are spaced apart.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENT

Figure 1:
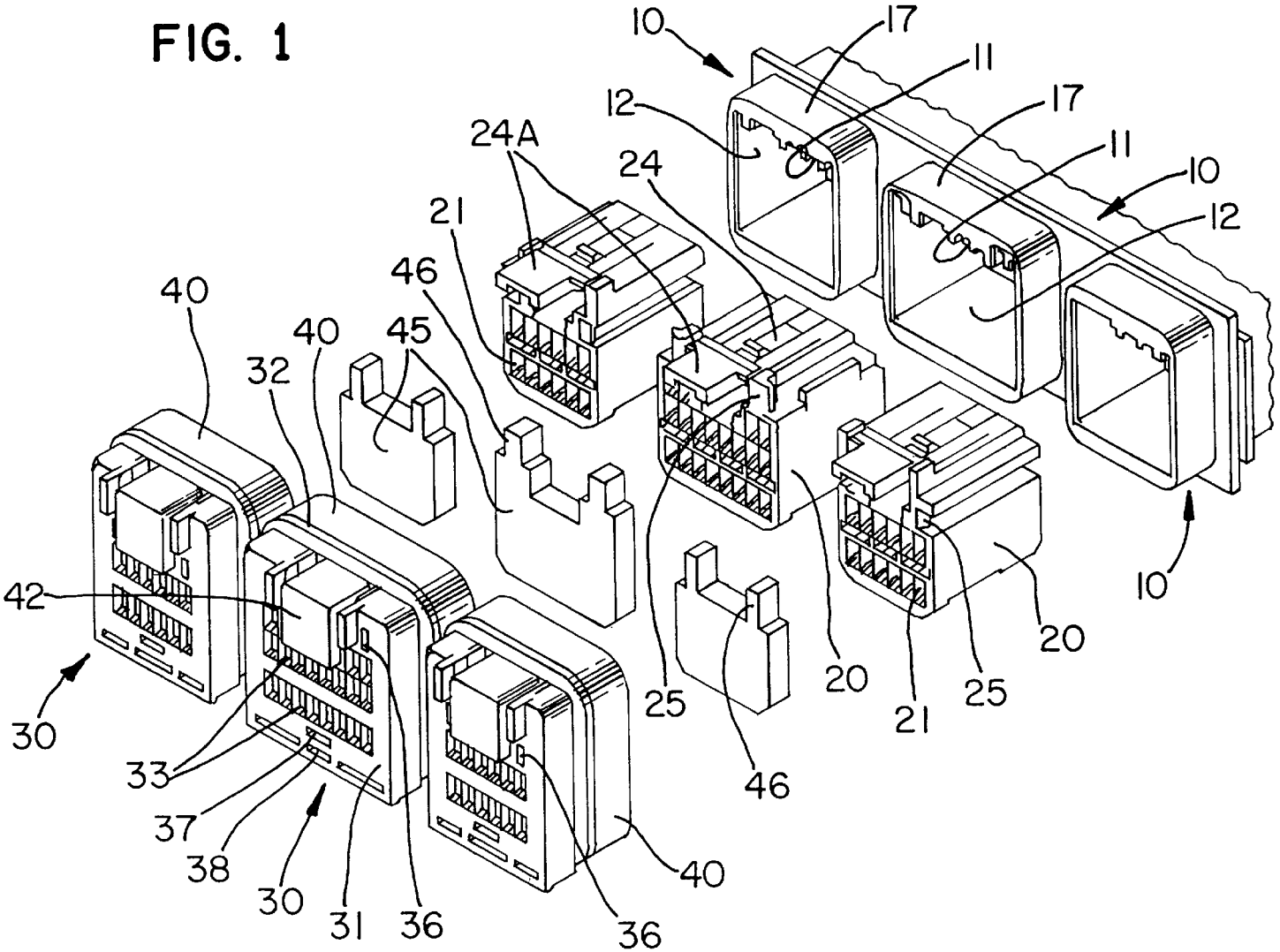
FIG. 1 is a disassembled diagonal view of a first embodiment of the invention.
Figure 2:
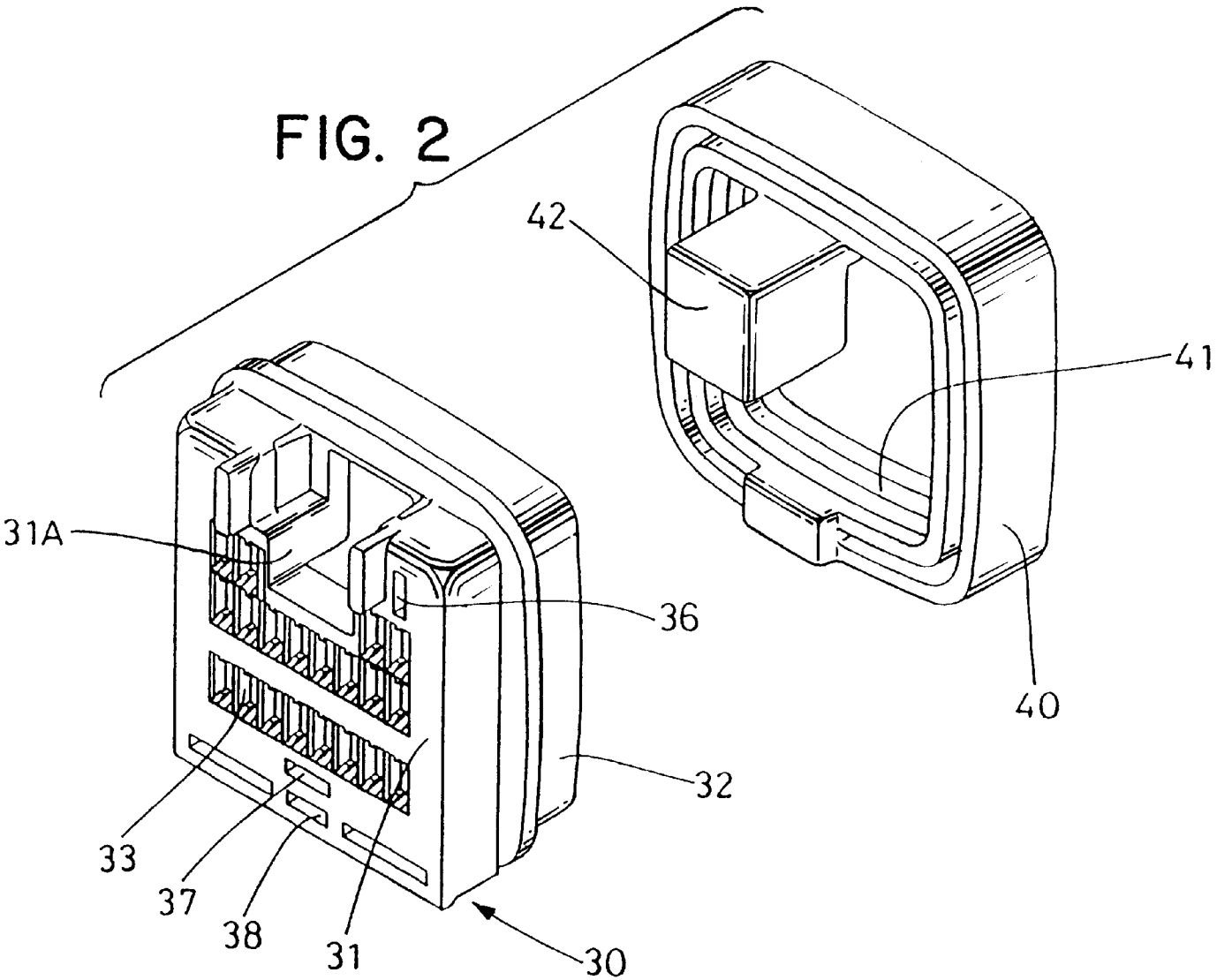
FIG. 2 is a diagonal view showing a cover and a ring-like seal of the first embodiment 1 in a state of hypothetical separation in order to show their shape.
Figure 3:
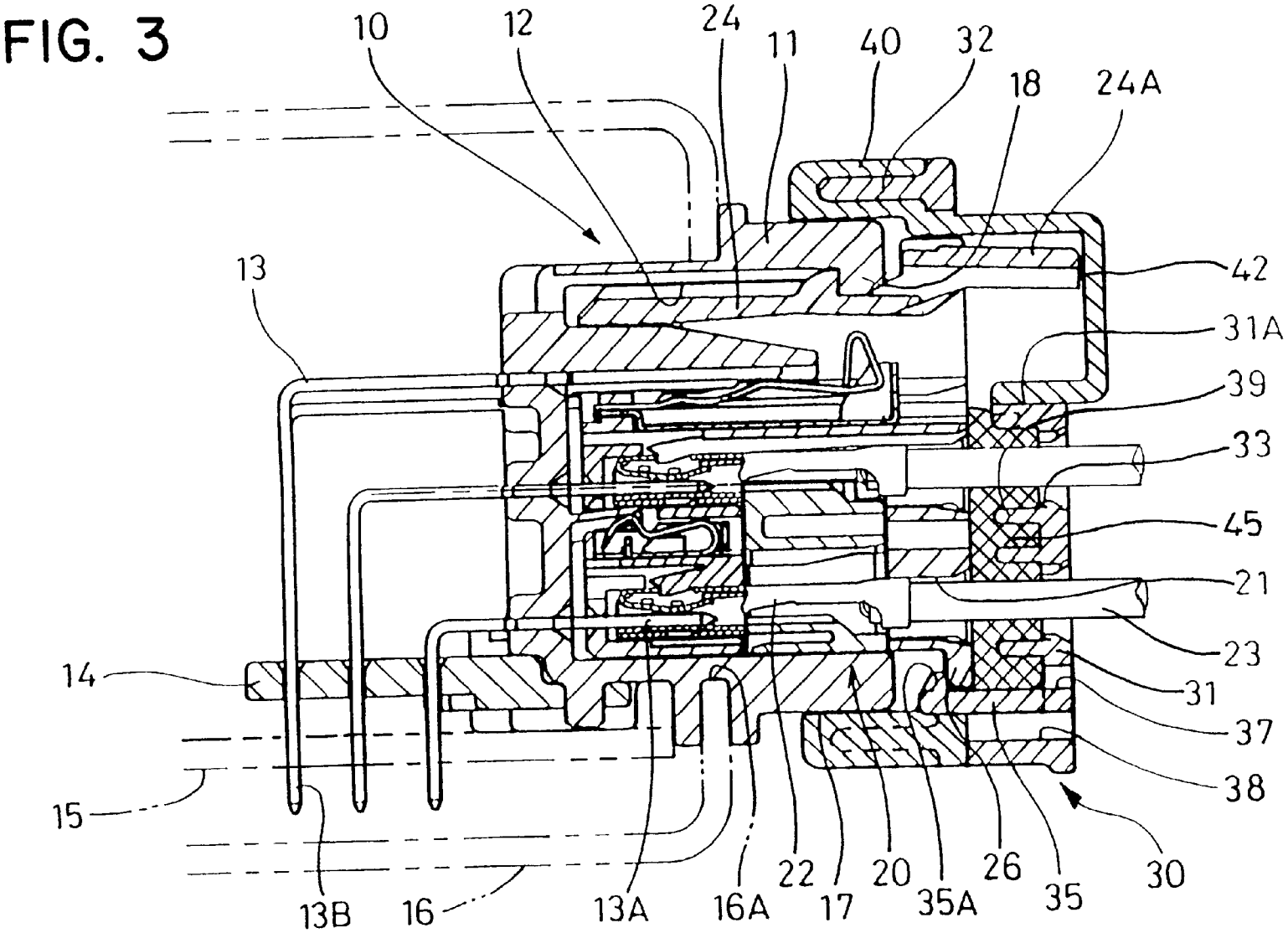
FIG. 3 is a vertical cross-section showing an attached state.
Figure 4:
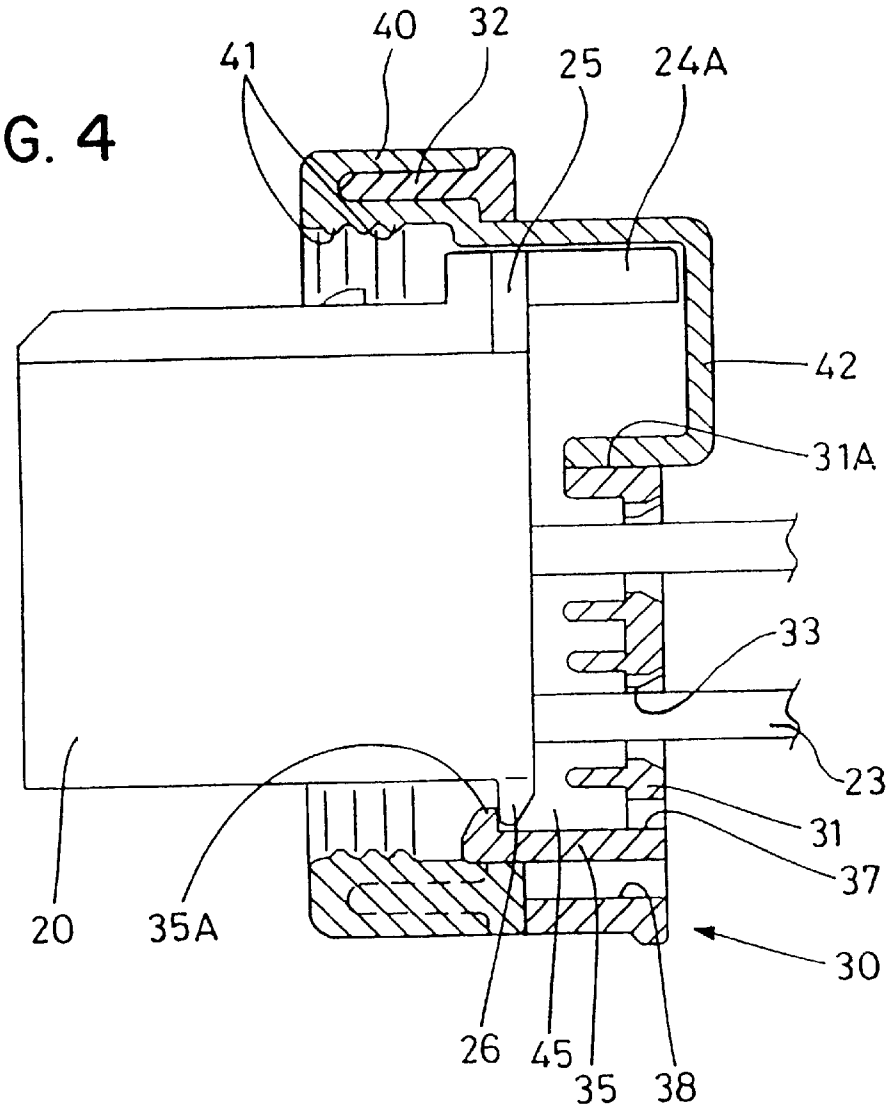
FIG. 4 is a vertical cross-section showing a female connector separated from a male connector, a gel seal and the cover.
Figure 5:
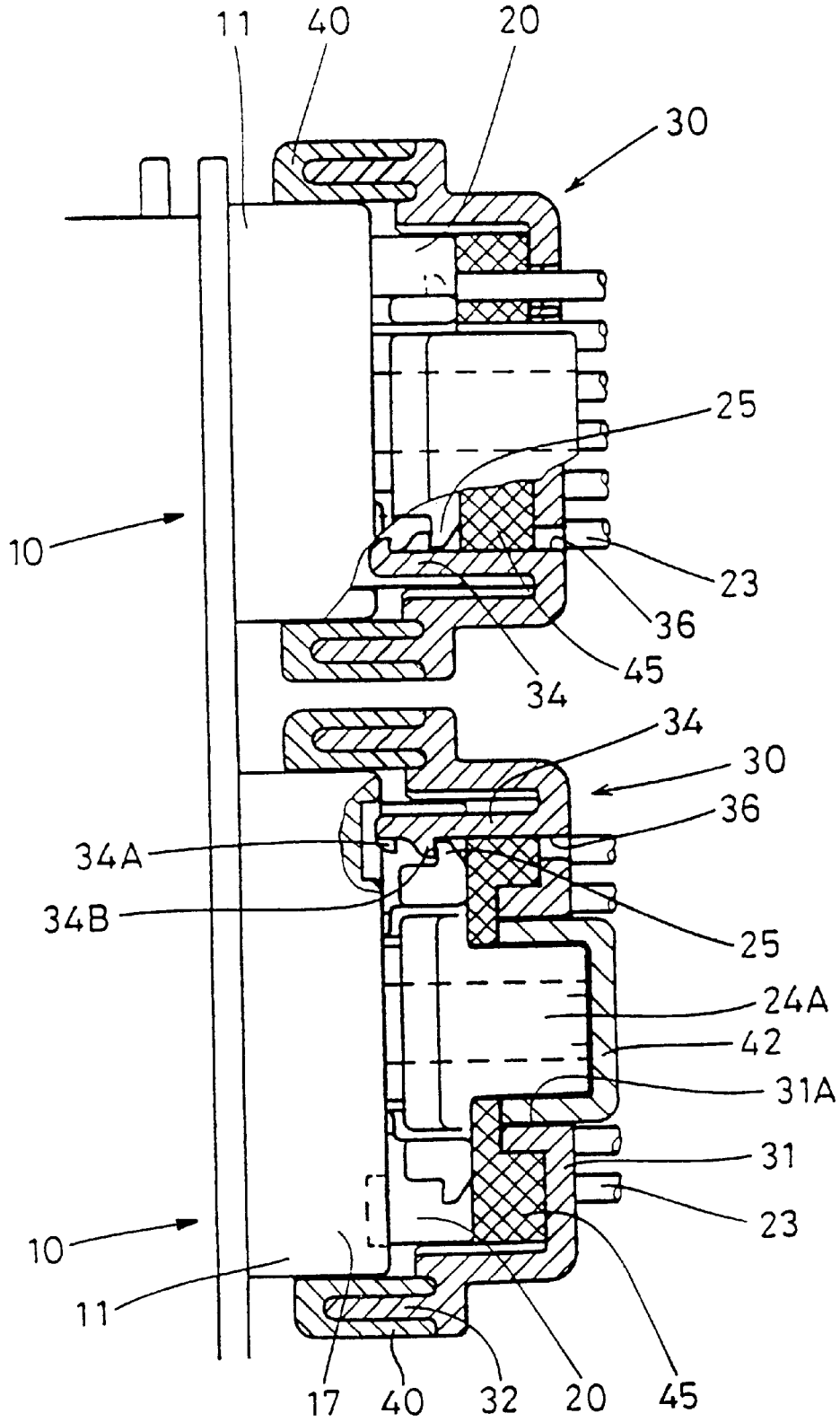
FIG. 5 is a partial horizontal cross-section showing the first embodiment in an attached state.

A first embodiment of the present invention is described below with the aid of FIGS. 1 to 5.

A connector assembly comprises a male connector 10, a female connector 20, a cover assembly 30, a ring-like seal 40 and a gel seal 45. These, when fitted together, form three transversely adjoining sections.

The basic structure of these three sections is identical. The two sections located to the left and right have the same number of terminals, and each is symmetrical in shape. However, the central section differs from the left and right sections in the number of terminal fittings and in shape. Moreover, the ring-like seals 40 and the gel seals 45 are similar, and the two side sections are identical in shape and size. Consequently, the following explanation chiefly describes the central section, a detailed explanation of the two side sections being omitted, and the same symbols being used for these.

A hood member 11 is provided separately on a concave fitting member 12 within each of the three male connectors 10, these parts being formed in a unified manner from plastic. A tab 13A of a male terminal fitting 13 faces into each of the fitting members 12, the end opposite to the tab 13A of the male terminal fitting 13 constituting a connecting member 13B which passes through an alignment plate 14 and connects with a circuit board 15.

These three male connectors 10 are fixed to a machine case 16, this machine case 16 housing the circuit board 15. The male connectors 10 protrude into an anterior half portion of the hood member 11, anterior with respect to a window 16A of the case 16. Sealing material (not shown) is introduced via an edge of the window 16A, thereby waterproofing the interior of the case 16.

The outer circumference of the anterior end of each hood member 11 forms a seal face 17 that fits tightly with the ring-like seal 40. In addition, the ceiling face of each fitting member 12 has a locking protrusion 18 which fits with a locking arm 24 of the female connector 20.

The female connector 20 is made from plastic and, with the exception of its posterior end, the majority thereof is housed within the fitting member 12, thereby fitting together with the male connector 10. The rear face (posterior face) of the female connector 20 has a plurality of terminal insertion holes 21, female terminal fittings 22 being inserted therethrough. When the female terminal fittings 22 are in an inserted state, electric wires 23 fixed thereto extend towards the exterior from the terminal insertion holes 21.

The locking arm 24 is formed on the upper face of the female connector 20, this locking arm 24 being resiliently bendable and extending in a posterior direction in a cantilevered fashion. A protruding end thereof protrudes beyond the rear face of the female connector 20. While the female connector 20 is being fitted into the concave fitting member 12, the locking arm 24 makes contact with the locking protrusion 18 and bends downwards (towards the upper face of the female connector 20) and, when the two connectors 10 and 20 have reached a correct fitting position, the locking arm 24 returns resiliently to its original position and fits together with the locking protrusion 18, thereby locking the two connectors 10 and 20 in a latched state. The locking arm 24 is released by pressing downwards an operating member 24A located on the posterior end of the locking arm 24.

A pair of stopping protrusions 25 face outwards from both sides of the locking arm 24 on the upper face of the female connector 20, and a fitting protrusion 26 faces downwards from the lower edge of the connector 20.

The cover assembly 30 is made of rigid plastic, and comprises a sheet-like cover 31 slightly larger than the rear face of the female connector 20, and a tubular seal 32 extending in an anterior direction from the circumference edge of the cover 31. A plurality of through holes 33 are formed on the cover 31, these corresponding to each of the terminal insertion holes 21 of the female connector 20. The female terminal fittings 22 are inserted into the female connector 20 via these through holes 33 and, in this inserted state, the electric wires 23 extend from the through holes 33 to the exterior of the cover assembly 30.

A pair of stopping arms 34 protrude to the left and right from the upper end of the inner face of the cover 31, these stopping arms 34 fitting with the stopping protrusions 25. Temporary stopping members 34A face inwards on the protruding edges of these stopping arms 34, and main stopping members 34B, which also face inwards, are formed at a location further towards the base end of the stopping arms 34. The stopping protrusions 25 are held between the temporary stopping members 34A and the main stopping members 34B, thereby temporarily maintaining the cover assembly 30 in position relative to the female connector 20. When the cover assembly 30 is pushed from this temporarily stopped state in the direction of the female connector 20, the main stopping members 34B fit with the stopping protrusions 25 and the cover assembly 30 is retained.

A fitting arm 35 is formed on the lower end of the inner face of the cover 31, the fitting arm 35 having a stopping claw 35A which fits with the fitting protrusion 26. When the cover assembly 30 is retained, the fitting arm 35 fits with the fitting protrusion 26 and prevents the lower portion of the cover assembly 30 from separating from the female connector 20.

Further, holes 36 and 37 open onto the cover 31, these holes 36 and 37 being formed when the temporary stopping members 34A, the main stopping members 34B and the stopping claw 35A are moulded. A bending space 38 for the fitting arm 35 also opens onto the cover 31.

A plurality of protrusions 39 protrude from the upper and lower edges of the through holes 33 on the inner face of the cover 31. These protrusions 39 do not make contact with the gel seal 45 when the cover assembly 30 is in the temporarily retained state. However, when the cover assembly 30 is in the fully retained state the protrusions 39 protrude into the gel seal 45, thereby regulating distortion of the gel seal 45.

The ring-like seal 40 is provided along the edge of the tubular seal 32 of the cover 30, the ring-like seal 40 clamping the outer and inner faces of the tubular seal 32 along their entire circumference. The ring-like seal 40 is made from rubber. Through a two-component moulding process, the rubber seal is formed in a unified manner with the cover 30. Consequently there is no gap between the ring-shaped seal 40 and the cover 30. Lips 41 extend in the direction of the circumference face, along the inner face of the ring-shaped seal 40, these lips 41 fitting tightly with the entire circumference of the seal face 17 of the male connector 10.

That area of the cover 31 corresponding to the locking arm 24 is cut away, forming a cut-away portion 31A. A resilient bending member 42, made from rubber and joined to the ring-like seal 40, fits within this cut-away portion 31A. The resilient bending member 42, like the ring-like seal 40, is formed in a unified manner with the hard plastic cover 30 by means of a two-component moulding process. Consequently, there is no gap between the cut-away portion 31A and the resilient bending member 42. The resilient bending member 42 is box-shaped and encircles the operating member 24A of the locking arm 24. When the resilient bending member 42 is made to bend in a resilient manner, the lock of the locking arm 24 can be released from the exterior.

The gel seal 45 is made from silicone gel and is a flat plate formed in an approximately square shape. The gel seal 45 fits between the rear face of the female connector 20 and the cover 31. The gel seal 45 is slightly thicker than the distance between the cover 31 and the female connector 20 when the cover assembly 30 is fully engaged. As a result, there are no gaps at all between the cover 31, the gel seal 45, and the rear face of the female connector 20 when these are in an attached state. Furthermore, the gel seal 45 is large enough to cover all of the terminal insertion holes 21 and the through holes 33. Protruding members 46 protrude from the upper edge of the gel seal 45, these protruding members 46 covering the holes 36 created during the moulding of the temporary stopping members 34A and the main stopping members 34B. In addition, the lower edge of the gel seal 45 covers the holes 37 created during the moulding of the fitting protrusion 26 of the fitting arm 35.

Next, the order of attachment of the present embodiment will be explained. First, the gel seal 45 is positioned on and pushed onto the rear face of the female connector 20. The adhesive force of the gel seal 45 causes it to adhere tightly to the rear face of the female connector 20, and all of the terminal insertion holes 21 are covered by the gel cover 45. Next, when the cover assembly 30 is pushed so as to cover the female connector 20, the stopping arms 34 fit with the stopping protrusions 25 and the cover assembly 30 reaches the temporarily stopped state. At this juncture, the tubular seal 32 fits with the outer circumference of the female connector 20, thereby maintaining the position of the cover assembly 30 relative to the female connector 20, and each through hole 33 corresponds to its corresponding terminal insertion hole 21 with the gel cover 45 intervening between the two. Next, the female terminal fittings 22 are made to pierce the gel seal 45 by being pushed through the through holes 33, the electric wires 23 are gathered together, and the female terminal fittings 22 are inserted further until they reach a prescribed location within the female connector 20. After insertion has been completed the electric wires pass through the gel seal 45.

After the female terminal fittings 22 have been inserted, the cover assembly 30 is pushed onto the female connector 20 and reaches a fully stopped state. At this juncture, the stopping arms 34 and the fitting arm 35 fit respectively with the stopping protrusions 25 and the fitting protrusion 26, thereby maintaining the cover assembly 30 in the fully retained state. As this occurs, the gel seal 45 is clamped between the cover 31 and the female connector 20, the gel seal 45 thereby covering the terminal insertion holes 21 and the through holes 33 in a water-proof manner and fitting tightly around the outer circumference of the electric wires 23. Moreover, the protrusions 39 protrude into the gel seal 45, thereby regulating its movement in the direction of the face of the gel seal 45. Further, the holes 36 and 37 of the cover 31 are sealed by the gel seal 45, and the bending space 38 of the fitting arm 35 is covered from its interior side by the ring-like seal 40. In this manner, all of the openings in the cover 31 and all of the terminal insertion holes 21 in the female connector 20 are sealed when the cover assembly 30 is attached.

Next, the female connector 20 and the cover assembly 30 which has been attached together are fitted into the concave fitting member 12 of the male connector 10, and the locking arm 24 fits with the locking protrusion 18, thereby locking the two connectors 10 and 20 in a fitted state. The ring-shaped seal 40 fits tightly with the seal face 17 of the male connector 10, thereby sealing the portions of the two connectors 10 and 20 that fit together. Moreover, although the fitting together of the two connectors 10 and 20 causes the locking arm 24 to bend resiliently, this resilient bending is carried out within the resilient bending member 42 and therefore the locking arm 24 does not interfere with the cover assembly 30 or the ring-shaped seal 40 so as to cause them to move. Furthermore, the operating member 24A of the locking arm 24 is positioned alongside the upper face of the resilient bending member 42 with almost no space between the two. As a result, when the two connectors 10 and 20 are to be separated, pushing the upper face of the resilient bending member 42 will push the locking arm 24 downwards, and the lock of the two connectors 10 and 20 will be released.

In the embodiment described above, the portions of the connectors 10 and 20 which fit together are water-proofed by the ring-shaped seal 40, and the terminal insertion holes 21 in the rear face of the female connector 20 are water-proofed by the gel seal 45. The female connector 20 does not itself perform any water-proofing function and, consequently, a non-water-proofing type female connector 20 can also be used where water-proofing is required.

Furthermore, the cover assembly 30 is provided with the ring-shaped seal 40 in order to water-proof the portions of the connectors 10 and 20 which fit together and, as a result, a separate seal need not be fitted to water-proof the portions of the connectors 10 and 20 that fit together. Consequently, fewer attachment processes are required. Moreover, the gel seal 45 is compressed between the cover assembly 30 and the female connector 20. This compressing force is exerted on that portion of the electric wires 23 which pass therethrough, and consequently the seal is improved for these portions. Furthermore, since the cover assembly 30, which needs to be hard, and the ring-shaped seal 40, which needs to be resilient, are formed in a unified manner through a process of two-component moulding, fewer components are required and manufacture is simpler compared to the case in which separate components are attached.

Additionally, the resilient bending member 42 is formed at a location corresponding to the locking arm 24. As a result, the lock releasing function of the locking arm 24 can be performed by moving the resilient bending member 42 without moving the cover 30. Operability is thereby improved.

Further, the fitting together of the stopping arms 34 with the stopping protrusions 25 temporarily maintains the terminal insertion holes 21 and the though holes 33 in a fitted state, thereby making the insertion of the female terminal fittings 22 easier. Similarly, the stopping arms 34 and the stopping protrusions 25 maintain the cover assembly 30 in the fully stopped state on the female connector 20, thereby making the fitting with the male connector 10 easier.

Figure 6:
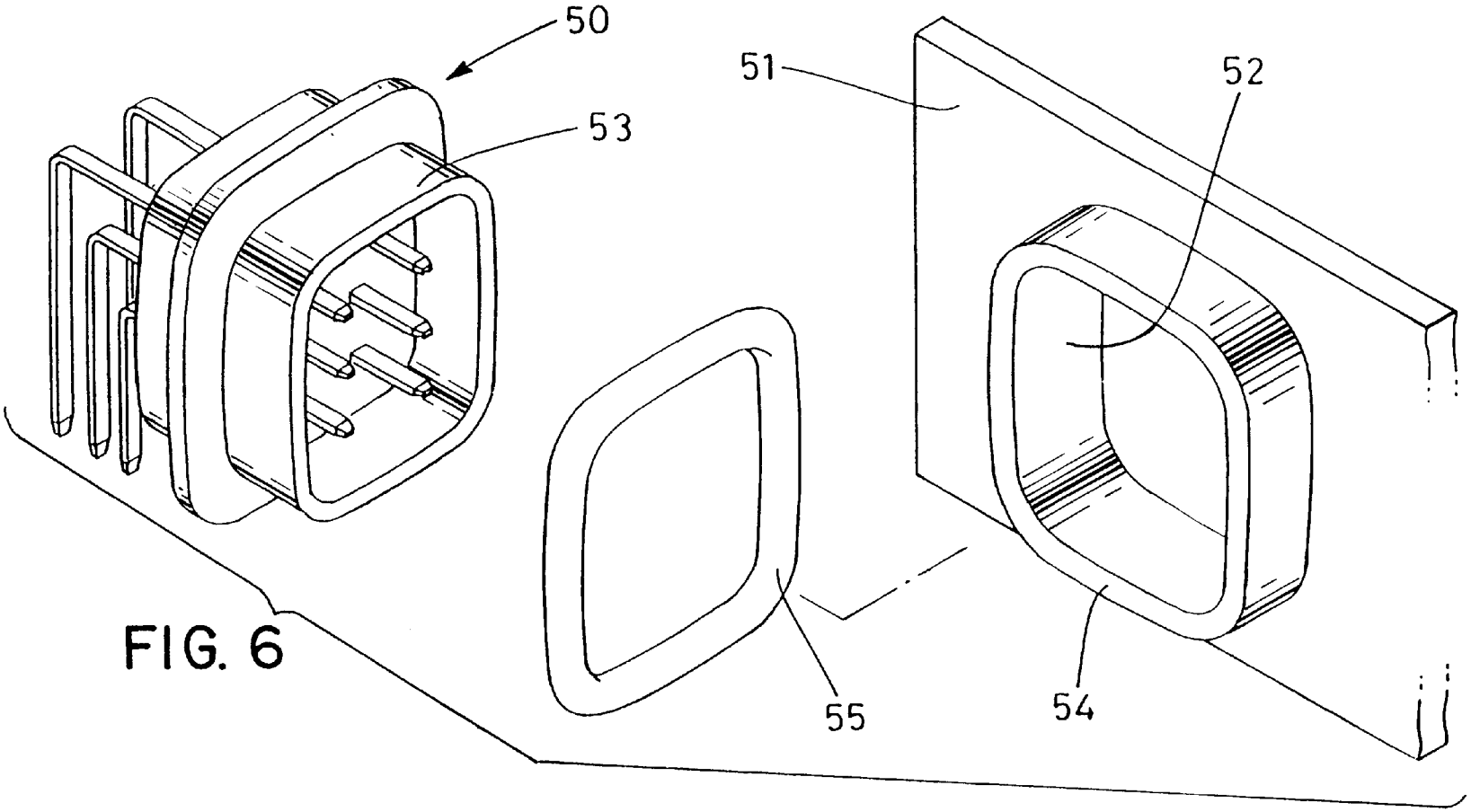
FIG. 6 is a disassembled diagonal view of a male connector of a second embodiment.

A second embodiment of the present invention is described below with the aid of FIG. 6.

The second embodiment has a male connector 50 having a differing configuration to that of embodiment 1. Parts which are the same as embodiment 1 have the same symbols and an explanation of the structure, operation and effects thereof is omitted.

In the embodiment described above three male connectors 10 are formed in a unified manner. In embodiment 2, by contrast, three male connectors 50 are formed as independent components. These male connectors 50 are attached in a unified manner to a sheet-like attachment member 51 having three attachment holes 52. The male connectors 50 are fixed therein by means of a conventional locking means (not shown), by making hoods 53 of the male connectors 50 enter into each attachment hole 52. Further, a ring-like seal 55 is compressed between the outer circumference face of each male connector 50 and the inner circumference face of a sealing cylindrical member 54, this sealing cylindrical member 54 protruding along the circumference edge of each attachment hole 52. The ring-like seal 55 water-proofs the attachment hole 52. Although the hood 53 has an overall angular shape, the four corners of the outer circumference are arc-shaped, and can thus be sealed reliably.

In embodiment 2 the male connectors are independent components which can be attached to the attachment member 51. Consequently, the attachment member 51 can be interchanged so that the shape or location of the attachment hole 52 varies, and male connectors 50 which have a differing number of terminals or a different shape can be fitted optionally thereto. Consequently there is a high degree of design freedom.

The present invention is not limited to the embodiments described above with the aid of figures. For example, the possibilities described below also lie within the technical range of the present invention. In addition, the present invention may be embodied in various other ways without deviating from the scope thereof.

(1) in the embodiment described above, the ring-like seal fits tightly with the outer circumference face of the concave fitting member. However, according to the present invention, it may equally well fit tightly with the inner circumference face of the concave fitting member, or the end face of the opening circumference edge of the concave fitting member.

(2) In the embodiment described above, the cover is made from hard plastic. However, according to the present invention, it may equally well be made from soft plastic or from hard or soft rubber.

(3) In the embodiment described above, the ring-shaped seal is made from rubber. However, according to the present invention, the ring-shaped seal may equally well be made from silicone gel.

(4) In the embodiment described above, the gel seal is made from one single sheet. However, according to the present invention, the gel seal may equally well be divided into a plurality of sheets.

(5) In the embodiment described above, the gel seal is a flat sheet. However, according to the present invention, the gel seal may equally well be provided with protrusions which fit with the through holes or the terminal insertion holes.

(6) In the embodiment described above, the cover and the ring-like seal are made in a unified manner through a process of two-component moulding. However, according to the present invention the cover and the ring-shaped seal may equally well be formed as individual components and attached later.

(7) In the embodiment described above, the resilient bending member is provided on the cover in order to operate the locking arm. However, according to the present invention, the resilient bending member may be absent. In this case, the release operation of the locking arm may be performed after removing the cover.

(8) In the embodiment described above, the explanation refers to a case in which the locking arm is provided on the female connector. However, according to the present invention, the locking arm may alternatively be provided on the male connector.

(9) In the embodiment described above, the stopping means is provided to maintain the cover and the female connector in an attached state. However, the present invention may equally well be without such a stopping means.

(10) In the embodiment described above, the cover is attached indirectly to the male connector via the intermediary of the stopping means and the female connector. However, according to the present invention, the cover may also be attached directly to the male connector.

What is claimed is:

1. An electrical connector assembly comprising a male connector, and a female connector adapted to connect therewith, the female connector having terminal insertion apertures at a side opposite to the male connector, the assembly further including a waterproofing cover for said female connector and having a peripheral seal for sealing engagement with a periphery of said male connector, said cover having through apertures in register with said terminal insertion apertures, wherein said assembly further includes a gel seal interposed between said female connector and cover, said gel seal being adapted to allow electrical terminals to be passed therethrough from said through apertures to said terminal insertion apertures, and adapted to seal said terminal insertion apertures against passage of moisture.

2. An assembly according to claim 1 wherein said cover is rigid, and said gel seal is sheet-like and relatively deformable, the seal being compressed between said cover and female connector in use.

3. An assembly according to claim 2 wherein said peripheral seal is relatively flexible compared with said cover, and is formed uniformly therewith by a two-component moulding process such that the cover and the peripheral seal are unified as a one-piece member.

4. An assembly according to claim 1 wherein said peripheral seal is relatively flexible compared with said cover, and is formed uniformly therewith by a two-component moulding process such that the cover and the peripheral seal are unified as a one-piece member.

5. An assembly according to claim 1, said male connector and female connector having releasable latch means therebetween, said cover enclosing said latch means in use and having a flexible membrane whereby said latch means can be actuated indirectly from an exterior of said assembly.

6. An assembly according to claim 1 and further including releasable retention means between said cover and said female connector.

7. An assembly according to claim 6 wherein said releasable retention means provide the cover with a first retention location and a second retention location, and the cover is closer to said female connector in the second retention location than in the first retention location.

8. An assembly according to claim 7 wherein said first retention location retains said gel seal in an undeformed state.

9. An assembly according to claim 1 wherein said cover further includes protrusions facing towards said female connector in use, and engageable in said gel seal to restrict lateral deformation thereof.

10. An assembly according to claim 1 and including a plurality of gel seals arranged in a single plane to seal said terminal insertion apertures.

11. An assembly according to claim 1 wherein said male connector is adapted for connection to a substrate, a ring-like seal being provided to seal said male connector and substrate against passage of moisture from the exterior to the interior thereof.

* * * * *